United States Patent [19]

Gueret

[11] 4,249,521

[45] Feb. 10, 1981

[54] IMPLEMENT FOR MASSAGING THE CUTANEOUS COVERING

[75] Inventor: Jean-Louis H. Gueret, Paris, France

[73] Assignee: L'Oreal, Paris, France

[21] Appl. No.: 32,685

[22] Filed: Apr. 23, 1979

[30] Foreign Application Priority Data

| | | | |
|---|---|---|---|
| Apr. 24, 1978 | [FR] | France | 78 12063 |
| Dec. 6, 1978 | [FR] | France | 78 34330 |
| Dec. 6, 1978 | [FR] | France | 78 34331 |

[51] Int. Cl.[3] ..... A61H 7/00

[52] U.S. Cl. ..... 128/62 R; 15/110

[58] Field of Search ..... 128/62 R, 67, 65, 62 A; 15/110, 187, 188, 190, 195, 196

[56] References Cited

U.S. PATENT DOCUMENTS

| | | | |
|---|---|---|---|
| 1,007,879 | 11/1911 | Lee | 128/65 |
| 1,267,039 | 5/1918 | Akin | 15/110 |
| 1,817,585 | 8/1931 | Samuel | 128/62 R |
| 1,819,628 | 8/1931 | Van Sant | 128/65 |
| 2,129,082 | 9/1938 | Byrer | 15/110 |
| 4,003,372 | 1/1977 | Willoby | 128/65 |
| 4,081,877 | 4/1978 | Vitale | 15/188 |

FOREIGN PATENT DOCUMENTS

| | | | |
|---|---|---|---|
| 2346209 | 9/1973 | Fed. Rep. of Germany | 151/110 |
| 152060 | 10/1920 | United Kingdom | 15/110 |

*Primary Examiner*—John D. Yasko

*Attorney, Agent, or Firm*—Brisebois & Kruger

[57] ABSTRACT

A massaging implement including resilient pads having portions which are alternately more flexible when engaged in one direction than when engaged in the opposite direction. Each pad can be discontinuous and take the form of spaced apart fingers or barbs in a row or can be a continuous wavy pad. The implement can take the form of a brush, massage glove, or soapy water dispensing container.

19 Claims, 10 Drawing Figures

IMPLEMENT FOR MASSAGING THE CUTANEOUS COVERING

BACKGROUND OF THE INVENTION

It is known that there are different massaging implements and instruments for manual use which are used to create localized hyperaemia in the areas of the skin subjected to massaging. This localized hyperaemia consists of a blood congestion due to activation of the condition of the underlying circulation, and it can promote the penetration of appropriate substances. Thus, this effect can be used particularly in the cosmetic field, for causing different treating creams or lotions to penetrate into the congested skin regions caused by massaging.

Among current massaging instruments, there may be mentioned horsehair gloves and massaging brushes, which have on an active face a multiplicity of points or barbs which, while passing over the skin, cause a slight depression thereof and by reaction a localized hyperaemia.

SUMMARY OF THE INVENTION

The present invention aims at providing an applicator or implement for massaging particularly efficiently the cutaneous covering, without risk of injury or abrasion of the epidermal layers.

The present invention has then as its object the novel industrial product in the form of an applicator or implement usable for massaging the cutaneous covering, on at least one active face of which are provided projecting pads, continuous or discontinuous, which are intended to contact the skin, these pads being formed from a resiliently deformable flexible material, characterized by the fact that each pad extends along a mean wavy-shaped line and is formed from elements connected or not, which are alternately either convex in one direction or concave in the opposite direction, each of said elements having a higher resistance to bending when acting on its convex part and a lesser resistance when acting on its concave part.

The advantage of the above defined applicator is twofold: in the first place, the efficiency of the cutaneous massaging is considerably improved, in comparison with that obtained with current massaging instruments, such as a horsehair glove or brush. In fact, the friction against the skin of continuous or discontinuous pads having alternately areas whose resistance to bending in the direction of movement of the applicator is high and areas whose resistance to bending in the same direction is less, causes on the skin meandering or wavy depressions, which move over the skin during the forward motion of the applicator. Second, since the pads are made from a resiliently deformable flexible material, such an applicator allows energetic massaging of the cutaneous covering without risk of injury or abrasion of the epidermal layers and it can be perfectly adapted to the different morphologies of the users.

In a preferred embodiment, the pads are formed from non-connected elements in the form of fingers or barbs disposed in parallel rows which are preferably evenly spaced from each other; the barbs in the same row are substantially identical and disposed alternately front to back; the barbs have a truncated cone shape whose section narrows towards the rounded point, each truncated cone having, in one area of its lateral wall, a depression which forms the concave part of the barbs, the rest of the truncated side wall forming the convex part; the concave depression provided in each of the truncated cone shaped barbs has a cylindrical surface whose axis is substantially perpendicular to the axis of the truncated cone.

The present invention also aims at providing a massaging brush on at least one of the active faces of which are provided the above defined continuous or discontinuous pads.

In an advantageous embodiment of the massaging brush of the invention, the continuous or discontinuous pads are formed from a single piece with a support which consists of a flexible plate mounted on a rigid mount; the support plate has a cut-out in the shape of an ellipse and, when the pads are formed from non-connected elements or barbs, these latter are disposed in rows substantially perpendicular to the large axis of the elliptical cut-out; the rigid mount comprises an elongated cavity for receiving the support plate, the longitudinal section of said cavity having also a substantially elliptical shape; the rigid mount is integral with a handle inserted or not which extends along an axis substantially perpendicular to the rows of barbs.

The present invention aims furthermore at providing an applicator allowing not only efficient massaging of the cutaneous covering but also cleaning and exfoliation of the dead cutaneous cells. In such an applicator, a perforated sole piece which supports the continuous or discontinuous pads is associated with a container which contains a hydrosoluble product such as a cake of soap for example, which allows, by previously dipping the applicator in water, massaging of the cutaneous covering in the presence of soapy water. The originality of the soap-holder applicator of the invention resides in particular to the provision of a perforated support on which is disposed the flexible sole piece supporting the continuous or discontinuous pads, so as to avoid collapsing or sinking-in of this latter, either because the user bears heavily on the applicator during massaging, or because the cake of soap contained in the container is used-up and can no longer therefore serve as a support for the sole piece.

In an advantageous embodiment of the soap-holder applicator, the sole piece and the pads are formed as a single piece from a moulded rubbery material; the flexible sole piece is disposed on a bearing surface formed by a perforated support which closes the opening of the container; the flexible sole piece has the shape of a spherical dome whose convexity is turned outwardly of the associated container, the bearing surface of the sole piece having a curved shape complementary to the sole piece; the flexible sole piece is fixed on a cylindrical skirt with which the perforated support is provided, this latter being removably connected to the container; the skirt of the perforated support is connected by spokes to a central ring, the spokes and central ring forming the bearing surface for the flexible sole piece; the securing of the flexible sole piece to the perforated support is effected by engaging a snap-fit lug or flange provided on one of the parts inside an annular groove of complementary shape provided on the other part; non-connected elements or barbs are disposed in concentric circles, the barbs of the same circle being evenly spaced from each other; on each of the circles, the barbs are regularly alternated to be either convex in a radial direction, or concave in the opposite radial direction.

The present invention aims finally at providing a massaging glove on one at least of the faces of which are provided the above defined continuous or discontinuous pads. According to an original feature of the massaging glove of the invention, the pads are continuous and extend along mean wavy lines. Preferably, the way lines of two adjacent pads are in phase opposition, so that a pad passing over the skin creates, on the surface of the skin, a depression having the form of a ripple or wave which, during the passage of the following pad, is reversed. The efficiency of the massaging is further reinforced due to the continuous and periodic variation of the transverse section of the pads which each present hollows alternating with crests. Thus, during rectilinear massaging, the cutaneous covering may be subjected to the action of pads each having, in relation to the massaging direction, very flexible concave parts and alternately convex parts which are not very flexible, this difference of flexibility being increased, in one of the directions of movement of the glove, by the fact that the concave parts form the crests, whereas the convex parts form the hollows of the pads. It is in fact known that the bending capacity of a pad also depends on its height.

In an advantageous embodiment of the massaging glove, the glove and the continuous or discontinuous pads which it comprises are formed as a single piece by moulding a rubbery material; the glove is in the form of a pocket whose bottom is provided with three separate openings for passing therethrough the forefinger, the second finger and the third finger of the hand; both faces of the glove cover substantially the palm and the back of the hand while leaving bare the thumb and the little finger, as well as the last phalanges of the forefinger, and the second and third fingers; the pads are continuous and each extend along a mean wavy line whose mean axis is approximately perpendicular to the longitudinal median line of the glove; the mean wavy lines, along which the pads are disposed, have substantially the same period and the same amplitude; the mean wavy lines of two adjacent pads are in phase opposition, so that, for a given direction of movement parallel to the longitudinal median line of the glove, after a concave part of a pad there follows the convex part of the adjacent pad; the glove comprises on each of its two faces, pads different in height, the average height of the pads of one face being greater than the average height of the pads of the other face; the pads have a triangular cross-section with rounded tip; the cross-section of each pad varies continuously and periodically along its mean wavy line, so as to form hollows alternating with crests on the corresponding face of the glove; the cross-section of a pad is, at any point of said pad, homothetic to the cross-section at another point; the maximum and minimum cross-sections of the same pad are alternately disposed at the curved apexes of the mean wavy line along which the pad considered is disposed.

For a better understanding of the present invention, there will be described hereafter, by way of examples, purely illustrative and not limitative, three embodiments shown in the accompanying drawings.

Figure 1:
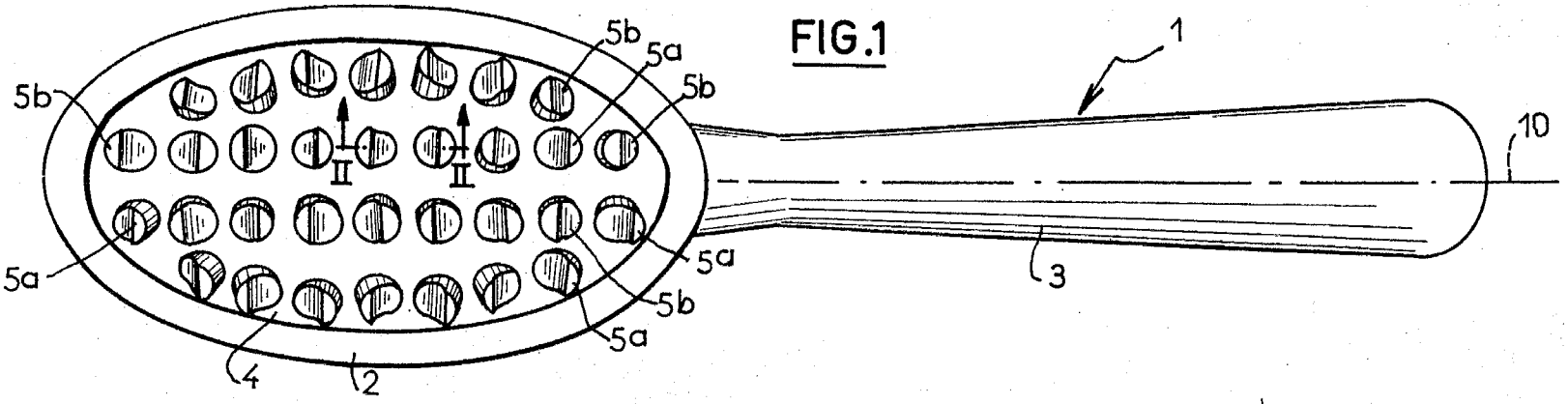
FIG. 1 shows in perspective a massaging brush according to the invention.
Figure 2:
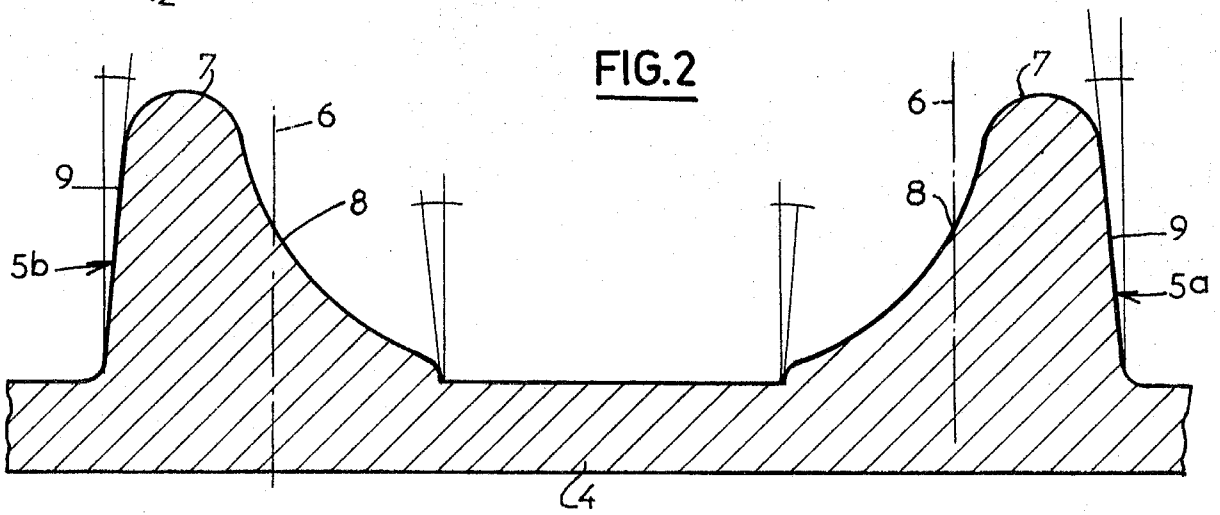
FIG. 2 shows, on an enlarged larger scale, a partial section of the fingers of the brush, along II—II of FIG. 1.

Referring to FIGS. 1 and 2 of the drawings, at 1 can be seen, shown as a whole, a brush for massaging the cutaneous covering. The frame or mount 2 of the brush is formed in a single piece with a handle 3. The mount 2 and handle 3, which is integral therewith, may be formed from any appropriate material, for example, from wood or by moulding a plastic material. As a variation, the handle 3 can be formed as an independent part which is inserted in mount 2. On one of the faces of mount 2 there is provided an elongated cavity whose longitudinal section is substantially ellipitical and inside which is mounted a flexible support 4 on which are provided in relief barbs or fingers 5*a*, 5*b* which are intended to contact the skin during massaging.

In this embodiment, the flexible support 4 and fingers 5*a*, 5*b* are formed as a single part by moulding an elastic or a rubbery material; the flexible support 4 is in the form of a disc with an elliptical outline; the surface of flexible support 4 is slightly greater than that of the opening of the cavity of mount 2 so that the flexible support 4 has, when it is positioned on mount 2, a curved configuration whose convexity is directed outwardly of the brush. Support 4 can be secured in the cavity of mount 2 by cementing the periphery of the support to the elliptical edge of the cavity with, for example, a thermoplastic cement.

The originality of the massaging brush 1 results from the form and orientation given to fingers 5*a*, 5*b*. As can be seen in FIG. 1, fingers 5*a*, 5*b* are disposed in nine transverse substantially parallel rows evenly spaced from each other, each row of fingers comprising a pad means. These rows extend perpendicularly to the long axis of support 4 having the elliptical cavity, this long axis being an extension of the axis 10 of handle 3; the row which is the nearest to handle 3 and that which is the farthest from the handle each comprise two fingers 5*a* and 5*b* and the other rows four fingers; fingers 5*a*, 5*b* located at the periphery of the flexible support 4 are disposed along an ellipse which is substantially homothetic to that formed by the cavity of support 4.

The configuration of the fingers 5*a* is strictly identical to that of fingers 5*b*, only their relative orientation is different. Each finger 5*a*, 5*b* is a truncated cone whose axis of revolution is shown at 6. The side wall of the truncated cone tapers towards the rounded tip 7 of the fingers. On the truncated side of fingers 5*a*, 5*b* there is provided a concave shaped depression 8. This latter has a cylindrical surface of revolution whose axis is perpendicular to axis 6. Thus, each finger 5*a*, 5*b* has a concave depression 8 and a truncated cone shaped side wall 9 of a convex shape, which is opposite depression 8.

Fingers 5*a* have their convex part 9 facing toward handle 3 and their depression 8 situated opposite, whereas for fingers 5*b*, it is strictly the reverse, i.e. their depressions 8 face toward handle 3 and their convex part 9 is situated opposite. In other words, fingers 5*a* are disposed front to back in relation to fingers 5b. In the same row, the fingers are alternately disposed front to back and between the rows, the fingers form substantially a quadrangular mesh trellis, the two opposite apexes of each mesh comprising two fingers 5a, and the other two, two fingers 5b which are disposed front to back in relation to fingers 5a. A path traced along each row of fingers from tip 7 to tip 7 results in a sinuous or wavy line, and the fingers of a row constitute pad means.

Owing to their configuration, barbs or fingers 5a, 5b have a higher resistance to bending when they are applied by their convex part 9 against the area of skin to be massaged and a lesser resistance to bending when they make contact with their concave shaped depression 8. For this reason, when rectilinear massaging is carried out by moving brush 1 parallel to its axis 10, the area of the skin on which the brush 1 is moved is subjected to the action of a plurality of aligned fingers which are alternately not very flexible and very flexible; the aligned fingers passing over the skin create then a slight depression at the surface thereof, this depression having the form of a ripple or wave which, when the next alignment of fingers passes, is reversed since a finger 5a of one alignment is followed by a finger 5b having a different orientation and so a different flexiblity. The result is a very efficient massaging which causes in the trated zone an appropriate hyperaemia promoting the penetration or absorption of different treating creams or lotions. It will be noted that brush 1, because of the rubbery material from which fingers or barbs 5a, 5b are formed, and also because of the configuration which is given them, cannot cause abrasion or destruction by friction of the epidermal layers even during vigorous massaging.

Figure 3:
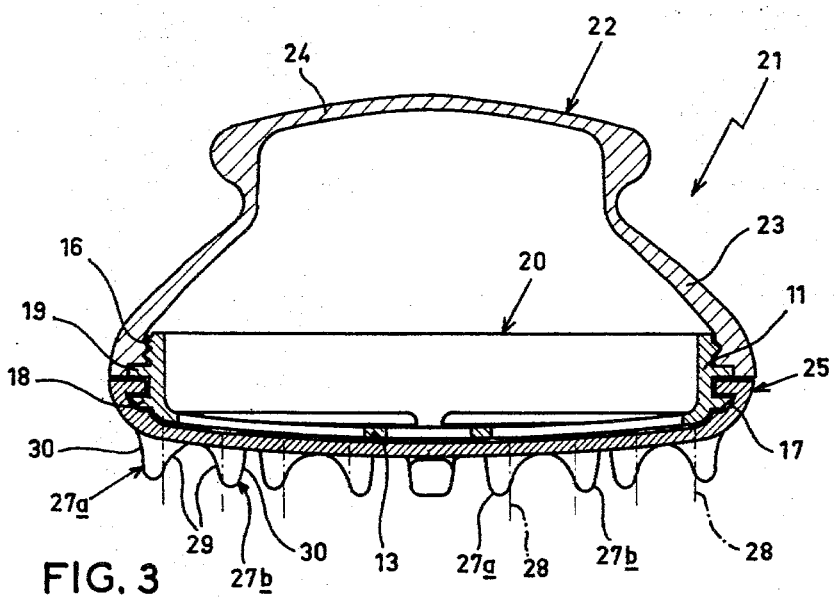
FIG. 3 shows in axial section a soap-holder type brush of the invention.
Figure 4:
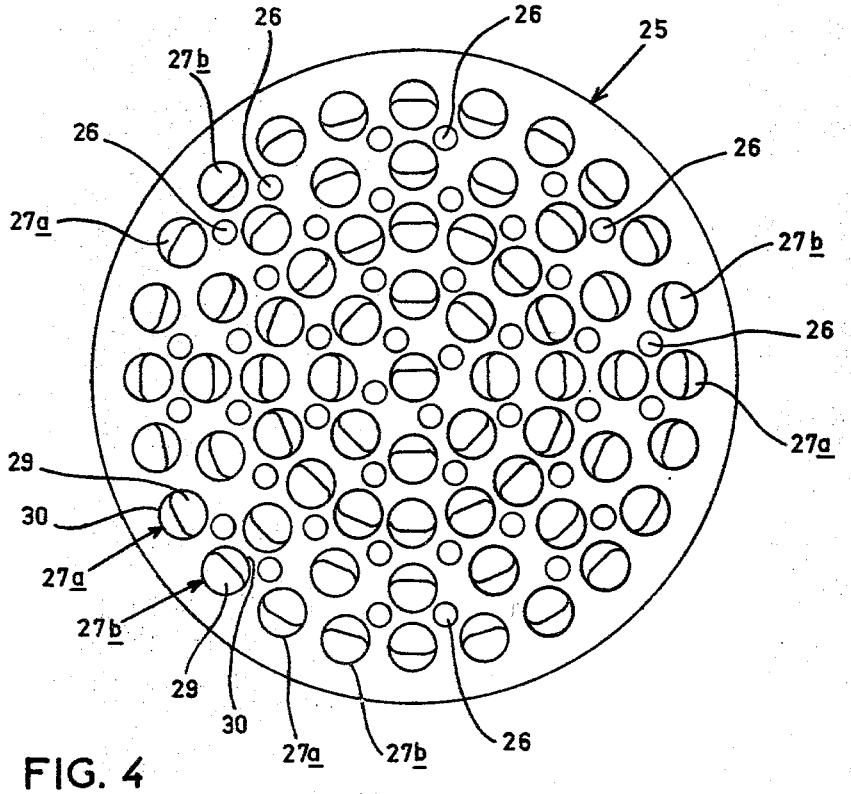
FIG. 4 shows a bottom plan view of the sole piece of the brush of FIG. 3.
Figure 5:
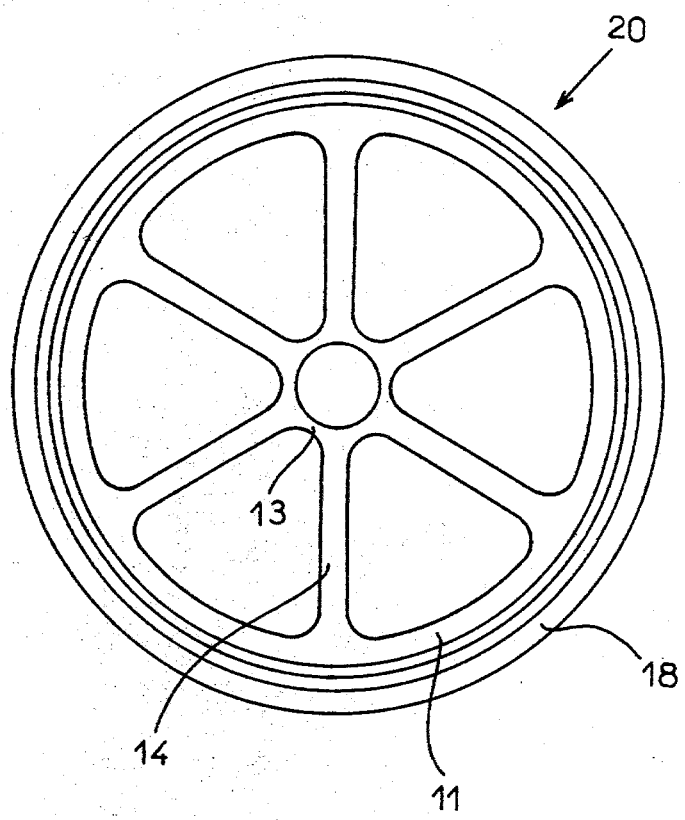
FIG. 5 shows a bottom plan view of a perforated support on which the sole piece is disposed.
Figure 8:
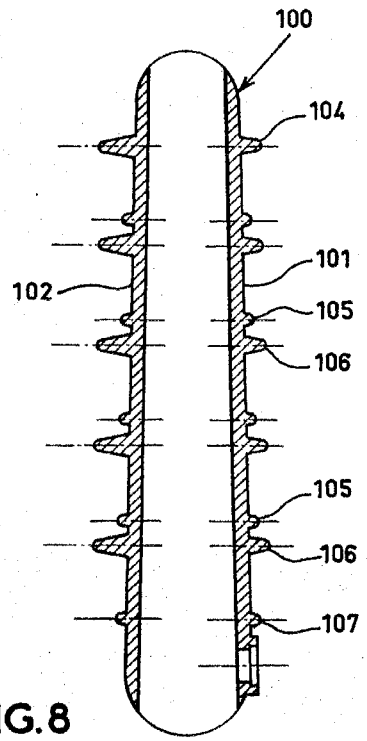
FIG. 8 shows a view in section taken along VIII—VIII of FIG. 6.

Referring to FIGS. 3 to 5, there can be seen shown as a whole at 21, a combined brush and applicator for massaging the cutaneous covering and for depositing, during massaging, a solution of a hydrosoluble product contained in a container 22.

In this embodiment, container 22 is intended to hold, as a water soluble product, a cake of soap (not shown). During the massaging operation, by dipping the applicator 21 into water, soapy water is obtained so that the massaging is accompanied by cleaning and exfoliation of the dead cutaneous cells.

Container 22 is in the form of a volume of revolution with a circular directrix; it comprises a side wall 23 closed at its top end by a head 24 and open at its other or bottom end. Side wall 23 widens out towards the open bottom. Head 24 with an axial C-shaped section, forms a handle for holding the applicator 21.

A sole or bottom piece shown as a whole at 25, closes container 22. Sole piece 25 is formed by moulding a flexible, resiliently deformable, rubbery material. Sole piece 25 has the shape of a spherical dome whose convexity is outwardly of the container; the peripheral edge region of this dome has a wall thickness greater than its central region. A plurality of perforations 26 are provided in the wall of sole piece 25 for contacting the cake of soap contained inside container 22 with water and allowing the resulting soapy water to exit therefrom.

On its active face which is directed outwardly of container 22, sole piece 25 is provided with a plurality of fingers or barbs 27a, 27b moulded integrally with the sole piece.

As can be seen in FIG. 4 of the drawings, barbs 27a, 27b are disposed in four concentric circles, the spacing between two adjacent concentric circles being substantially constant. A central barb is disposed on the axis of sole piece 25; barbs 27a, 27b of the smallest diameter circle are positioned and spaced 45° from one another, whereas the barbs of the largest diameter circumference are positioned at 15° from one another; barbs 27a, 27b of the two intermediate circumference circles are disposed at 22° 30′ from each other. The configuration of barbs 27a is strictly identical with that of barbs 27b, only their relative orientation differing. Each barb 27a, 27b is formed from a truncated cone whose axis is shown at 28 in FIG. 3. The side wall of the truncated cone narrows towards the rounded point of the barbs. On the truncated cone shaped side wall of barbs 27a, 27b there is provided a concave shaped depression 29. This latter has a cylindrical surface of revolution whose axis is perpendicular to axis 28. Thus, each barb 27a, 27b has a concave depression 29 and a truncated cone shaped side wall 30 having a convex shape which is opposite depression 29. It is believed evident that barbs 27a, 27b are substantially identical to barbs 5a and 5b of FIG. 2.

Barbs 27a, 27b are orientated circumferentially, the axes of their depressions 29 being perpendicular to a radial plane passing through the common center of the concentric circles. On each of the four concentric circles, barbs 27a, 27b are regularly alternated and disposed front to back: the depression 29 of barbs 27a is turned to face radially inwardly toward the center of sole piece 25 whereas depression 29 of barbs 27b is, on the contrary, turned to face radially outwardly of the center of sole piece 25. A path traced from tip to tip of the barbs in a circle results in a wavy or sinuous circular line and the barbs of a circle comprise pad means.

Barbs 27a, 27b present a higher resistance to bending when they are applied to their convex part 30 against the skin area to be massaged and a lesser resistance to bending when they make contact with their concave shaped depression 29. During rectilinear massaging achieved by moving sole piece 25 in any radial direction, the area of the skin along which sole piece 25 is displaced is subjected to the action of barbs 27a, 27b disposed, as we have seen, in concentric circles, each circle comprising alternately, barbs which are not very flexible and barbs which are very flexible as the sole piece is reciprocated; the barbs belonging to a circle create, when they pass over the skin, a slight depression at the surface thereof, a depression which has the form of a wave or ripple because of the difference in flexibility between barbs 27a and 27b; when the barbs of the following circle portion pass, there is produced a new wave or ripple at the surface of the skin which is, this time, staggered in relation to the preceding one. It can be noted that this massaging effect may be obtained whatever the direction of motion of the applicator since the barbs are disposed in concentric circles.

To avoid collapse of the rubbery material sole piece 25 during massaging or to prevent collapse of its wall when it is supported by the cake of soap and when this latter is used-up, flexible sole piece 25 is disposed on a rigid bearing surface formed by a perforated support 20 (FIG. 5). The perforated support 20 comprises a cylindrical skirt 11 serving not only for fixing sole piece 25 but also for its assembly on container 22; a central ring 13 is connected by spokes 14 to skirt 11. Central ring 13 as well as spokes 14 form for the flexible sole piece 25 a rigid bearing surface having a curved shape complementary to that of said sole piece. With such a rigid bearing surface, the flexible sole piece 25 does not collapse, but keeps its curved convex shape even if the applicator 21 is heavily applied to the cutaneous covering during massaging and if the cake of soap which is contained in the container 22 is used-up.

A male screw thread 16 having two threads is provided on skirt 11. This male screw thread cooperates with a corresponding female screw thread provided on the inner side wall 23 of container 22 in the vicinity of its bottom edge. An annular groove 17 is provided on the concave inner surface of sole piece 25 in the vicinity of its peripheral edge. Inside annuar groove 17 there engages a snap-fit lug or flange, 18 having a complementary shape, provided in relief on the outer wall of skirt 11 in the vicinity of its connection zone with spokes 14. The cooperation of the annular groove 17 and the snap-fit lug 18 ensures that sole piece 25 is secured on its perforated support 20. Between the male screw thread 16 and the peripheral lug 18, skirt 11 of the perforated support 20 comprises an outer flange 19 which engages in a cylindrical cavity of complementary shape provided on the peripheral edge of the side wall 23 of the container, when perforated support 20 is screwed onto the container.

It will be noted that the opening or the closing of container 22 for cleaning or for providing a new cake of soap, may be carried out without having to remove the flexible sole piece 25 from perforated support 20.

Referring to FIGS. 6 to 10 of the drawings, there can be seen shown at 100 as a whole a massaging glove in accordance with the invention, with which the skin is rubbed to activate particularly the blood flow and exfoliate the dead cutaneous cells.

Figure 6:
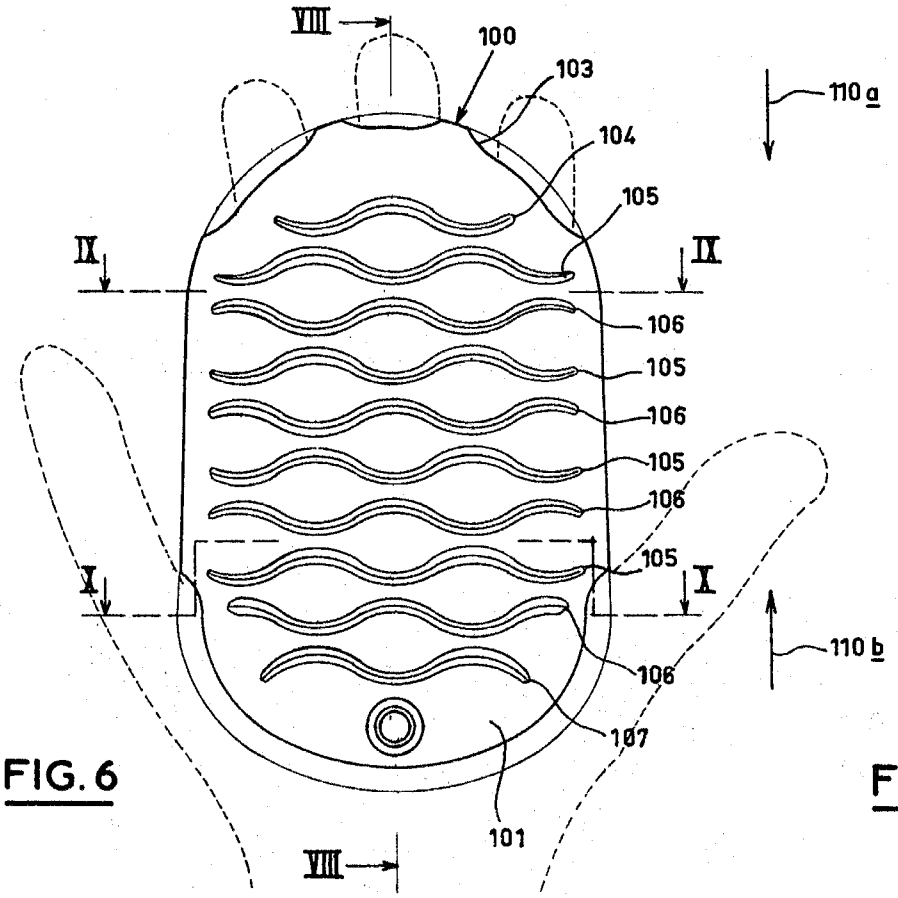
FIG. 6 shows a plan view of a massaging glove form of brush of the invention.

Glove 100 has the form of a flexible bag or pocket whose two large faces 101, 102 may cover equally the palm or the back of the hand. The bottom of the flexible pocket is provided with three elliptical openings 103 for passing therethrough the forefinger, the second finger and the third finger. As can be seen in FIG. 6, glove 100 covers, once in position, the palm and the back of the hand excluding the wrist and also leaves bare the thumb and the little finger, as well as the last phalanges of the three other fingers of the hand.

On each of the two faces 101, 102 of glove 100 are provided in relief pads in the form of ridges 104, 105, 106 and 107. The number, the disposition and the configuration of pads 104 to 107 provided on each of the active faces 101, 102 of the glove are identical; only their relative transverse section and, consequently, their height are different at different locations. As can be seen in FIGS. 7 to 10 of the drawings, the average height and, more precisely, the maximum height of the pads 104 to 107 on face 101 of the glove is slightly less than the maximum height of the pads of the opposite face 102. As the pads are more likely to bend, by rubbing against the cutaneous covering, the higher they are, the massaging action exerted by the two active faces 101, 102 of the glove will then be different; the active face 101, which comprises pads of a reduced maximum height, forms the so-called "hard" face of the glove whereas face 102, on which the maximum height of the pads is greater, forms the so-called "soft" face of the glove.

Glove 100, with its projecting pads 104 to 107, is formed as a single part by moulding a flexible rubbery material. Pads 104 to 107 of one face are approximately perpendicular to the longitudinal median line of said face. They have a triangular cross-section with rounded tip. In FIG. 6, it can be seen that pads 106 to 107 extend along mean wavy lines having substantially the same amplitude and the same period. Thus, in one direction shown by arrow 110*a* or in the opposite direction shown by arrow 110*b*, each pad has concave parts alternating with convex parts. The mean wavy lines of pads 105 are of opposite phase with those of pads 106: by moving in a given direction 110*a* or 110*b*, after the concave part of a pad 105 comes the convex part of an adjacent pad 106 and conversely, after a convex part of a pad 105 comes the concave part of an adjacent part 106. The mean wavy line of the end pad 104 is in phase with the mean wavy lines of pads 106 whereas end pad 107 has a mean wavy line in phase with those of pads 105. The end pads 104 or 107 are distinguished from pads 105 or 106 by their length since they only comprise three curved apexes instead of five, as is the case for pads 105 or 106 (see FIG. 6).

Figure 7:
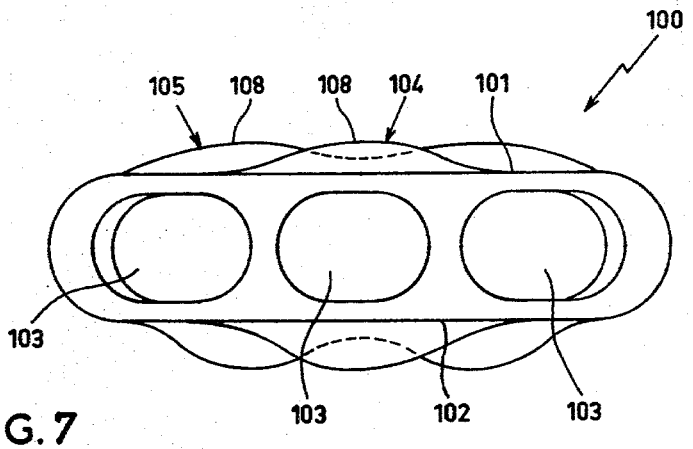
FIG. 7 shows an end view, looking along the finger end, of the glove of FIG. 6.
Figure 9:
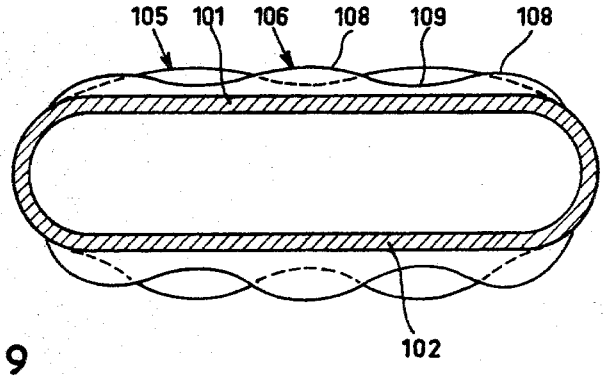
FIG. 9 shows a view in section taken along IX—IX of FIG. 6.
Figure 10:
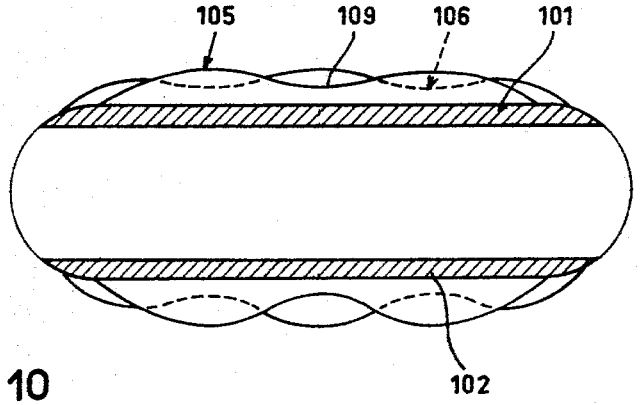
FIG. 10 shows a view in section along X—X of FIG. 6.

According to another important feature of the massaging glove according to the invention, the difference in flexibility of the pads is reinforced owing to the variation of the crosssection of the pads and, consequently, of their height. It will in fact be readily understood that pads of a greater height have a lower resistence to bending than pads of a lower height. In this embodiment, the cross-section of the pads varies continuously and periodically along their mean wavy line, so as to present cross-sections of minimum value which alternate with cross-sections of maximum value, the section of a pad being, at any given point of the pad, substantially homothetic to the cross-section at another point. This continuous and periodic variation of the cross-section of the pads results in (FIGS. 7 to 10) bosses or crests 108 alternating with hollows 109 and, since the different cross-sections of the same pad are homothetic, the average thickness of bosses 108 is greater than the average thickness of hollows 109. As can be seen in FIGS. 7, 9 and 10, the end pad 104 comprises a single boss 108, pads 106 three bosses separated by two hollows 109 and pads 105 two bosses 108 on each side of a hollow 109.

The approximately sinusoidal variation of the cross-section of each pad has the same period and the same amplitude but this sinusoidal variation is effected, for pads 104 and 106, in phase opposition with that of pads 105 and 107: if we go along the longitudinal median line and, for example, in the direction shown by arrow 110*a*, after boss 108 of pad 104 there follows the hollow 109 of a pad 105 then a boss 108 of pad 106 and so on as far as the hollow 109 of the end pad 107. It will be noted that the maximum section of bosses 108, and respectively the minimum section of hollows 109, are disposed at each curved apex of the mean wavy line of a pad.

If we assume that glove 100 is moved with a rectilinear massaging movement in the direction shown by arrow 110*a*, the area of skin to be massaged will then come, first of all, into contact with end pad 107, i.e. with its two boss shaped concave portions, which are separated by a hollow convex portion. The two concave portions of pad 107 have a greater flexibility than the intermediate convex portion, this difference in flexibility being increased by the fact that the height of pad 107 at the concave portions is greater than that of the convex portion. During the passage of the next pad 106, the area of the skin, over which a boss shaped concave portion of great flexibility had rubbed, is now subjected to the action of a convex hollow portion, having lesser flexibility of the pad 106 and, conversely, after the convex hollow portion which is not very flexible, of pad 107, there follows a boss shaped concave portion, which is very flexible, and so on. Consequently, the area of the skin, over which the glove is moved, is subjected to a plurality of pads having alternately, areas which are not very flexible, and very flexible areas, and after a not very flexible zone of a pad there follows a very flexible zone of the following pad. The result is a very efficient massaging which causes in the treated area an appropriate hyperaemia promoting the penetration or absorbtion of different treating creams or lotions.

It will of course be understood that the finger or pad arrangement of any of the disclosed embodiments can be substituted for the arrangements of any other embodiment. However, such substitutions are not shown or described in detail to avoid prolixity and repetition.

It will be understood that the above described embodiments are in no wise limiting and could be modified in any desirable way without departing from the scope and spirit of the present invention.

What is claimed is:

1. An implement for massaging the cutaneous covering comprising, at least one active face having a plurality of projecting pad means for contact with the skin, said pad means each being formed from a resiliently deformable flexible material, characterized by the fact that each pad means extends along a mean line and is comprised of portions which are alternately convex with respect to movement of the implement across the skin in one direction and concave with respect to movement of the implement in the opposite direction, each of said pad means presenting a resistance to bending when acting on its convex portion which is higher than the resistance to bending when acting on its concave portion, and wherein said pad means comprise spaced apart fingers disposed in substantially parallel rows, the fingers of the same row being substantially identical and oriented with their convex portions facing alternately in opposite direction.

2. An implement according to claim 1, wherein said fingers each comprise a truncated cone whose section narrows towards a rounded tip, each truncated cone having, in a region of its side wall, a depression which forms the concave part of the fingers, the remainder of the truncated cone shaped side wall forming the convex part.

3. An implement according to claim 2, that the concave depression provided on each of the fingers comprises a cylindrical surface whose axis is substantially perpendicular to the axis of the truncated cone.

4. An implement according to claim 1 comprising a brush having said pad means on at least one active face.

5. An implement according to claim 4, in which said pad means comprises spaced apart fingers disposed in parallel rows, and formed in one piece integral with a support, said support consisting of a flexible plate mounted on a rigid mount.

6. An implement according to claim 5, wherein the rigid mount is integral with a handle which extends along an axis substantially perpendicular to the rows of fingers.

7. An implement for massaging the cutaneous covering comprising, at least one active face having a plurality of projecting pad means for contact with the skin, said pad means each being formed from a resiliently deformable flexible material, characterized by the fact that each pad means extends along a mean line and is comprised of portions which are alternately convex with respect to movement of the implement across the skin in one direction and concave with respect to movement of the implement in the opposite direction, each of said pad means presenting a resistance to bending when acting on its convex portion which is higher than the resistance to bending when acting on its concave portion, and in which the pad means comprises spaced apart fingers disposed in concentric circles, the fingers in the same circle being regularly alternated to be convex in one radial direction and concave in the opposite radial direction.

8. An implement according to claim 7 comprising a sole piece, said pad means projecting from said sole piece, said sole piece having perforations, and means connecting said sole piece to a container adapted to contain a hydrosoluble product.

9. An implement according to claim 8, wherein said sole piece and said pad means are formed as a single integral piece from a moulded rubbery material.

10. An implement according to claim 8 wherein said sole piece is flexible and disposed on a bearing surface comprising a perforated support extending across an opening of the container.

11. An implement according to claim 10 wherein said flexible sole piece is snap-fitted to the perforated support, and said means connecting said sole piece to the container comprises a releasable connection between the support and the container.

12. An implement for massaging the cutaneous covering comprising, at least one active face having a plurality of projecting pad means for contact with the skin, said pad means each being formed from a resiliently deformable flexible material, characterized by the fact that each pad means extends along a mean line and is comprised of portions which are alternately convex with respect to movement of the implement across the skin in one direction and concave with respect to movement of the implement in the opposite direction, each of said pad means presenting a resistance to bending when acting on its convex portion which is higher than the resistance to bending when acting on its concave portion, and comprising a glove formed in a single piece by moulding a rubber material and having said pad means on at least one of its faces, and wherein said glove is in the form of a pocket whose bottom is provided with three separate openings for passing therethrough a forefinger, a second finger and a third finger of a hand.

13. An implement for massaging the cutaneous covering comprising, at least one active face having a plurality of projecting pad means for contact with the skin, said pad means each being formed from a resiliently deformable flexible material, characterized by the fact that each pad means extends along a mean line and is comprised of portions which are alternately convex with respect to movement of the implement across the skin in one direction and concave with respect to movement of the implement in the opposite direction, each of said pad means presenting a resistance to bending when acting on its convex portion which is higher than the resistance to bending when acting on its concave portion, and wherein said pad means are each continuous and each extend along a mean wavy line whose mean axis is approximately perpendicular to a longitudinal median line of the implement.

14. An implement according to claim 13, comprising a glove formed in a single piece by moulding a rubbery material and having said pad means on at least one of its faces.

15. An implement according to claim 13, wherein the mean wavy lines of two adjacent pad means are in phase opposition, so that for a given direction of movement parallel to the longitudinal median line of the implement a concave part of one pad means follows a convex part of the adjacent pad means.

16. An implement according to claim 13, wherein the cross-section of each pad means varies continuously and periodically along its mean wavy line so as to form hollows alternating with crests on a face of the implement.

17. An implement according to claim 16, wherein maximum and minimum cross-sections of the same pad means are located alternately at the curved apexes of the mean wavy line of said pad means.

18. An implement for massaging the cutaneous covering comprising, at least one active face having a plurality of projecting pad means for contact with the skin, said pad means each being formed from a resiliently deformable flexible material, characterized by the fact that each pad means extends along a mean line and is comprised of portions which are alternately convex with respect to movement of the implement across the skin in one direction and concave with respect to movement of the implement in the opposite direction, each of said pad means presenting a resistance to bending when acting on its convex portion which is higher than the resistance to bending when acting on its concave portion, and comprising a glove formed in a single piece by moulding a rubbery material and having said pad means on at least one of its faces, and wherein the glove comprises, pad means of varying height on each of its two faces, the average height of the pad means of one face being greater than the average height of the pad means of the other face.

19. An implement according to claim 18 wherein the pad means each have a triangular cross-section with rounded tip and wherein the cross-section of a pad means is, at any point of said pad means, substantially homothetic to its cross-section at another point.

* * * * *